United States Patent [19]

Engelberger et al.

[11] Patent Number: 4,886,415

[45] Date of Patent: Dec. 12, 1989

[54] FAN WITH AN ESSENTIALLY SQUARE HOUSING

[75] Inventors: Raimund Engelberger; Siegfried Harmsen, both of St. Georgen; Hilmar Kirchgessner, Villingen; Josef Schneider, St. Georgen, all of Fed. Rep. of Germany

[73] Assignee: Papst-Motoren GmbH, St. Georgen, Fed. Rep. of Germany

[21] Appl. No.: 83,792

[22] PCT Filed: Nov. 26, 1986

[86] PCT No.: PCT/EP86/00680

§ 371 Date: Sep. 25, 1987

§ 102(e) Date: Sep. 25, 1987

[87] PCT Pub. No.: WO87/03343

PCT Pub. Date: Jun. 4, 1987

[30] Foreign Application Priority Data

Nov. 26, 1985 [DE] Fed. Rep. of Germany ..... 3541787

[51] Int. Cl.[4] ..... F04D 29/66

[52] U.S. Cl. ..... 415/119

[58] Field of Search ..... 415/119, 219 R, 219 C; 417/353, 354

[56] References Cited

U.S. PATENT DOCUMENTS

| | | | |
|---|---|---|---|
| 2,325,222 | 7/1943 | Bretzlaff et al. | 417/350 |
| 2,631,775 | 3/1953 | Gordon | 417/360 |
| 3,809,503 | 5/1974 | Schlicker et al. | 417/352 |
| 4,073,597 | 2/1978 | Barnhart et al. | 415/201 |
| 4,128,364 | 12/1978 | Papst et al. | 417/354 |

FOREIGN PATENT DOCUMENTS

| | | | |
|---|---|---|---|
| 634449 | 8/1936 | Fed. Rep. of Germany . | |
| 1428195 | 12/1968 | Fed. Rep. of Germany . | |
| 1428273 | 1/1969 | Fed. Rep. of Germany . | |
| 1503609 | 7/1970 | Fed. Rep. of Germany . | |
| 1802523 | 9/1970 | Fed. Rep. of Germany . | |
| 2139036 | 2/1973 | Fed. Rep. of Germany . | |
| 2257509 | 6/1974 | Fed. Rep. of Germany . | |
| 2414649 | 9/1979 | France | 415/119 |
| 77200 | 5/1983 | Japan | 415/119 |
| 200395 | 9/1986 | Japan | 415/119 |
| 200396 | 9/1986 | Japan | 415/119 |
| 200397 | 9/1986 | Japan | 415/119 |
| 168226 | 3/1934 | Switzerland . | |

*Primary Examiner*—Robert E. Garrett
*Assistant Examiner*—John T. Kwon
*Attorney, Agent, or Firm*—Barnes & Thornburg

[57] ABSTRACT

A fan assembly for the cooling of electronic systems, where a square housing is provided with a central electric motor for the impeller, and a first main inlet surface of the housing is arranged perpendicular to the axis of rotation of the impeller and in parallel to the inflow direction, and where the flow through the fan is deflected by 90° after it leaves the impeller to exit, the housing at at least one lateral outlet surface that is perpendicular to the first main inlet surface which assembly results in a drastic reduction of noise.

18 Claims, 4 Drawing Sheets

FAN WITH AN ESSENTIALLY SQUARE HOUSING

BACKGROUND OF THE INVENTION

The invention relates to a fan with an essentially square housing and an impeller that is centrally driven by an electric motor; with the axis of rotation of the impeller being perpendicular to a first main inlet surface of the housing and in parallel to the inflow direction. The flow of air leaving the impeller being deflected by 90° leaving the fan housing at at least one lateral surface of the housing that is perpendicular to said first main surface; and wherein a bottom surface of said housing that is opposite the inlet surface being developed as a closed wall with the blade edges of the impeller on the outlet side being spaced a distance away from the bottom surface.

Initially fans were equipped with so-called radial impellers; i.e., the air is deflected in the impeller itself from the intake direction by 90° into the outlet plane. This results in a higher pressure yield than by means of the so-called axial impeller fans. Fans of this type are known from the German Published Patent Application 22 57 509 (DE-413). Similar fans are also known from DE-OS 21 39 036 (DE-409). In both cases, a conventional radial impeller was used in which the 90° deflection of the flow takes place inside the impeller.

However, solutions of this type (conversions of axial to radial flow) are also known where a deflection of the flow takes place in the area of the impeller itself although the shape of the impeller is that of an axial wheel.

Thus, it is stated in DE-AS 15 03 609 that the delivered medium is already subjected to a deflection in the first part of the impeller wheel and leaves the impeller wheel with a radial flow component. According to the objective that is described there, this solution seems to be useful mainly for very high pressure requirements. This prior solution also has a housing ring that expands conically in the direction of the flow delivery and extends approximately to over half the axial width of the impeller wheel. Because of this lack of complete covering of the axial width, the solution permits the radial flow component in the area of the impeller wheel. As far as the reduction of noise is concerned, this solution is still very imperfect.

Another previously known solution according to DE-OS 18 02 523, like the last-described arrangement, as far as the outward appearance is concerned, shows an axial impeller, but here also, the ring that surrounds the impeller extends only to the axial center of the impeller, so that a deflection of the air in radial direction takes place inside the impeller. In axial view, this arrangement is very large.

DE-PS 634 449 shows a spiral housing where the deflection of the air flow in radial direction takes place by means of very rounded blades in their central area. The impeller that is used here is also an axial wheel, but the blades themselves deliver air radially beyond their outer edges into the flow space-analogously to the two last-described solutions. The tube that extends from an inlet plane into the axial center of the blades and encloses it is tapered extensively in flow direction.

In all these previously known solutions, the blades have the function to deliver extensively in radial direction via their radially exterior blade edges, and the deflection of the air takes place, as in the case of the conventional radial impeller, inside said impeller. These solutions are not suited to sufficiently satisfy today's predominant objective of low noise while still retaining an axially compact fan.

In the electronics industry or in the data-processing industry, it is also common to use fans of this type in connection with larger housing boxes for the ventilating of the electronic system located in the apparatus. It is increasingly required in these cases that the noise level be low, particularly in the field of miniature fans having impeller diameters of less than 200 mm. In practice, the situation exists that more compromises can be made with respect to the pressure or volume per time, while very strict requirements exist with respect to noise levels. The result is that frequently fans of this type are operated at lower rotational speeds only for noise reasons. Thus, the constant demand with respect to a "noise minimization" is a predominant aspect in the development of fans of this type.

Within the scope of this objective, it was surprisingly found that a fan with an essentially square housing and an impeller that is centrally driven by an electric motor; with the axis of rotation of the impeller being perpendicular to a first main inlet surface of the housing and in parallel to the inflow direction. The flow of air leaving the impeller being deflected by 90° leaving the fan housing at at least one lateral surface of the housing that is perpendicular to said first main surface; and wherein a bottom surface of said housing that is opposite the inlet surface being developed as a closed wall with the blade edges of the impeller on the outlet side being spaced a distance away from the bottom surface is effective in its performance and extremely low in noise.

Thus, it was found, for example, that a fan that is constructed according to the state of the art, with rectangular parallelepiped dimensions of approximately 130×130×40 mm and was equipped with a conventional radial impeller, with respect to noise, was reduced to 44 dba by means of special measures, whereas the fan according to the invention, with the same dimensions and equipped with an essentially square housing and an impeller that is centrally driven by an electric motor; with the axis of rotation of the impeller being perpendicular to a first main inlet surface of the housing and in parallel to the inflow direction. The flow of air leaving the impeller being deflected by 90° leaving the fan housing at at least one lateral surface of the housing that is perpendicular to said first main surface; and wherein a bottom surface of said housing that is opposite the inlet surface being developed as a closed wall with the blade edges of the impeller on the outlet side being spaced a distance away from the bottom surface, and wherein the impeller is an axial impeller of the type that has an air-guiding outlet duct that is formed by a wall that radially on the outside completely surrounds the blades and where the air flow leaves the outlet edges of the impeller only in an axial direction, reduced this value to 38 dba. (This applies to both embodiments.) Naturally, comparable pressure and volume capacities exist in each case. Thus, in these operating cases, the pressure is relatively low and the volume is moderate, thus, in the case of the characteric pressure-volume curve, mainly in the medium range, at least on the right of the salient stability point of the characteristic pressure-volume curve, air flow has not yet "broken off".

Other advantageous developments are found with an essentially square housing and an impeller that is centrally driven by an electric motor; with the axis of rotation of the impeller being perpendicular to a first main inlet surface of the housing and in parallel to the inflow direction. The flow of air leaving the impeller being deflected by 90° leaving the fan housing at at least one lateral surface of the housing that is perpendicular to said first main surface; and wherein a bottom surface of said housing that is opposite the inlet surface being developed as a closed wall with the blade edges of the impeller on the outlet side being spaced a distance away from the bottom surface. The impeller is an axial impeller of the type that has an air-guiding outlet duct that is formed by a wall that radially on the outside completely surrounds the blades and where the air flow leaves the outlet edges of the impeller only in axial direction and has the impeller diameter approximately 20% or 30% smaller than the outer side dimensions of a rectangular parallelepiped housing. Also advantageous is having the impeller with its blade edges that are located on the inlet side, disposed in the area of the air inlet plane as well as having the impeller blade edges of the axial impeller located on the outlet side, disposed approximately in the center of the axial height of the fan. It was also found advantageous to have, at the area of the air inlet blade edges of the axial impeller, a housing radially directly outside the impeller, with rounding at its inlet, as well as in the area of the outlet blade edges of the axial impeller, having the housing have a rounding, radially outside the impeller, so that the air after leaving the axial impeller at first encounters an enlarged flow cross-section. This enlarged flow cross-section can be caused by a diameter that is at least about 10% larger than the outlet and is formed over the whole circumference thereof. Another advantage of the invention is to have the blades of the impeller extend at least over half the axial height of the fan. Still further, it was advantageous to have the impeller blades take up, one half to one third of the axial height of the fan, with an outlet of the fan extending from the end of the impeller to the bottom wall and amounting to one half to one third of the axial height of the fan. Also it is advantageous to have the height of the housing be about ⅓ of the impeller diameter. Additionally, it was found advantageous to have the interior surface surrounding wall of the housing defining the outlet of the fan to be an essentially cylindrical flow ring.

Probably, the advantageous effect can be expected not only in the case of a miniature fan of the type described in the following, but bascially also in the case of a larger construction. However, surprisingly, at least in the case of this miniature size, the combination according to the invention has proven to be extremely effective with respect to a minimizing of noise.

These and other objects, features, and advantages of the present invention will become more apparent from the following description when taken in connection with the accompanying drawing which show, for the purposes of illustration only, plural embodiments in accordance with the present invention, and wherein the figures show two embodiments of the invention.

FIG. 1 is a view from above and

FIG. 2 is a side view in partial section according to the cutting line II/II of FIG. 3.

FIG. 3 is a view from below of a square housing block in which an impeller is arranged concentrically.

A second embodiment is shown in FIGS. 4 to 9.

Figure 6:
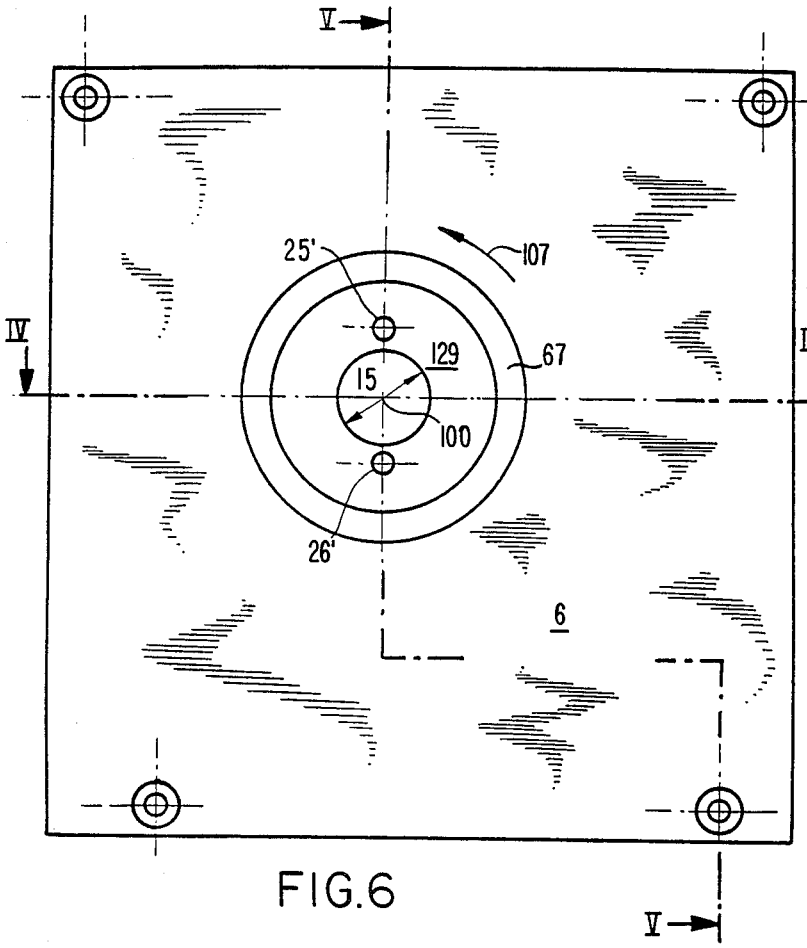
Figure 5:
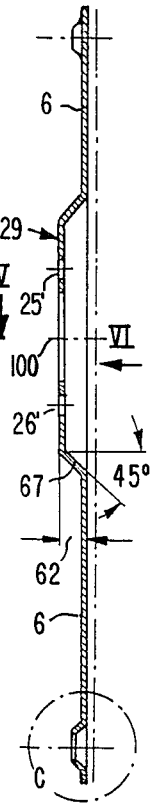
Figure 4:
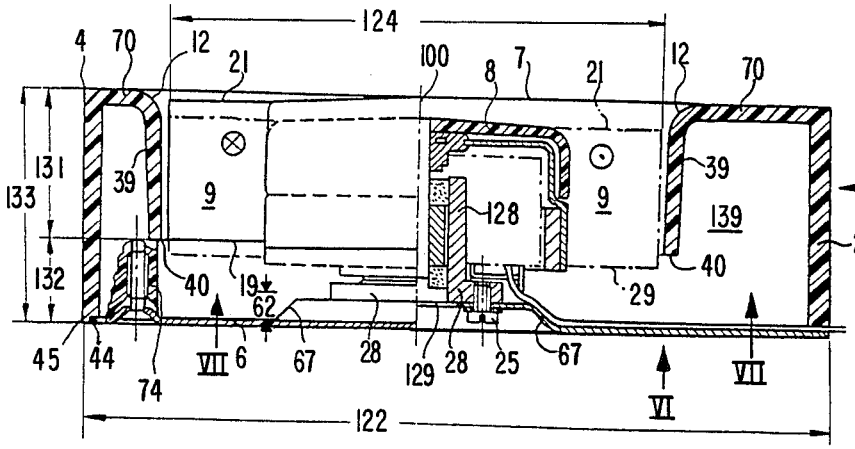
Figure 7:
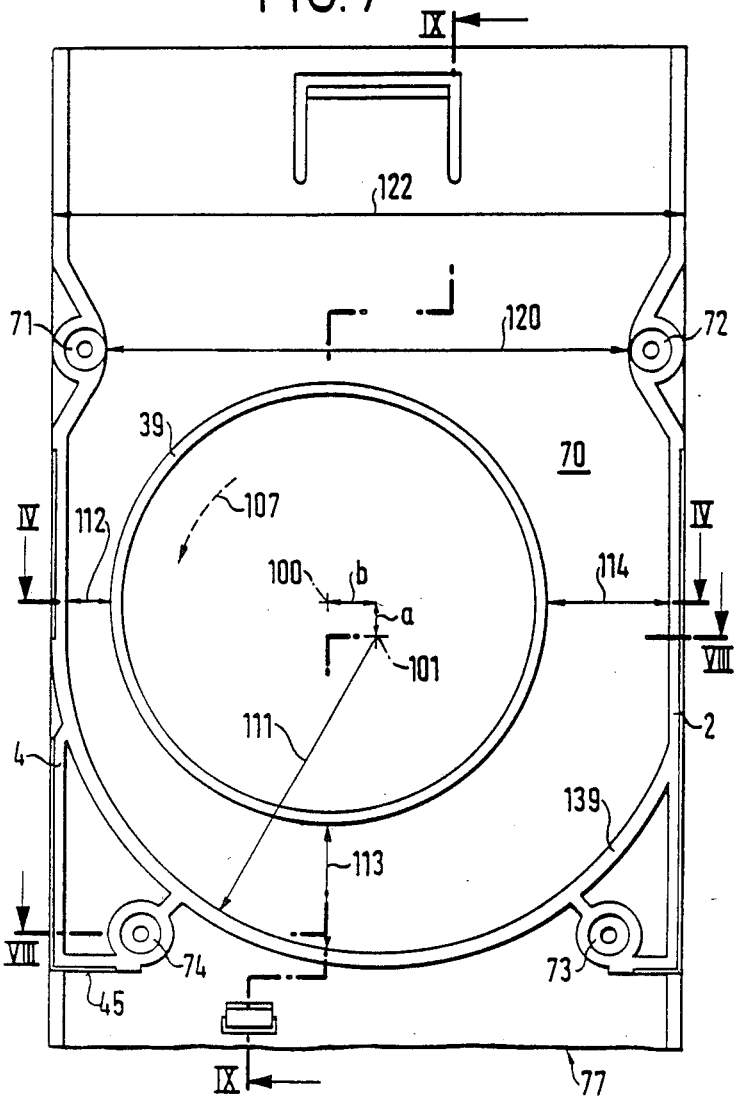

FIG. 4 is a partial sectional view according to the cutting line IV/IV of FIG. 7 (similar to FIG. 2) of a complete fan according to the second embodiment of invention;

FIG. 5 is a bottom sectional view of a component of FIG. 4 according to the cutting line V/V of FIG. 6;

FIG. 6 is a bottom view of this component according to the Arrow VI of FIG. 5;

FIG. 7 is a bottom view of the fan according to the Arrows VII in FIG. 4, with the base plate removed along with the motor and the impeller being fastened to it.

Figure 9:
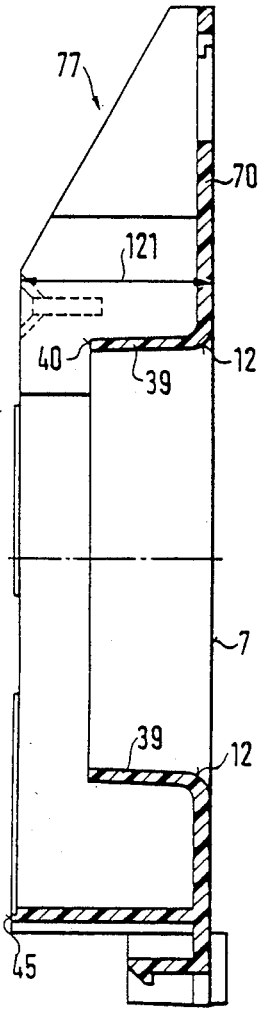
Figure 8:
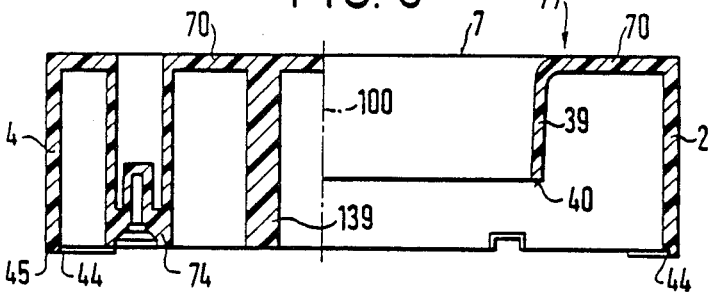
Figure 10:
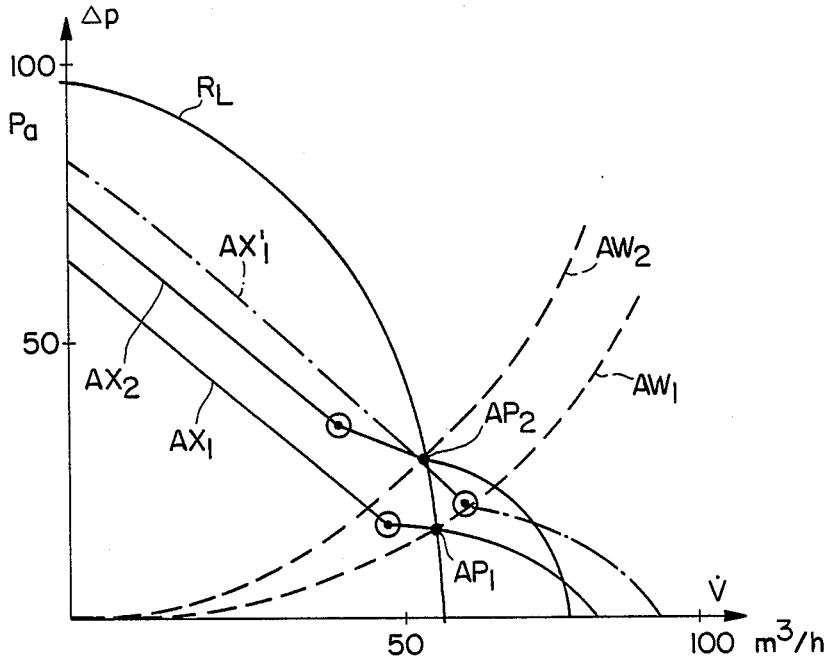

FIG. 8 is a sectional representation according to the cutting line VIII/VIII in FIG. 7; and FIG. 9 is a side sectional view according to the cutting lines IX/IX of FIG. 7;

FIG. 10 shows a graph plotting pressure rise across the fan (vertically) and flow volume (horizontally) for the operation of both embodiments by means of their pertaining operating points AP1 and AP2.

DETAILED DESCRIPTION OF THE DRAWINGS

Figure 1:
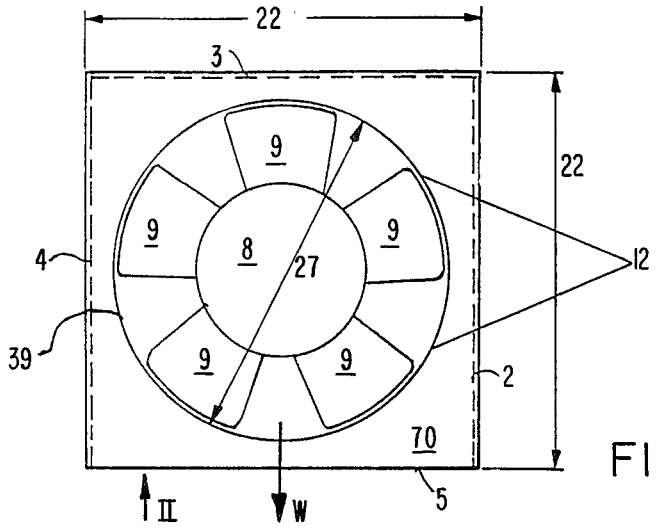
FIGS. 1 to 3 show a first embodiment.
Figure 3:
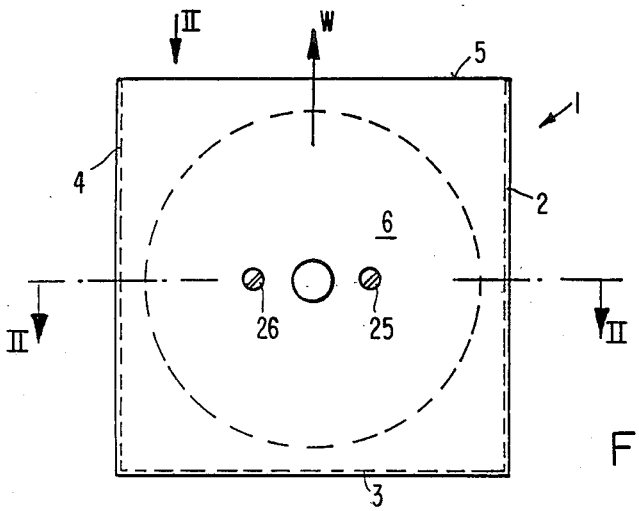
Figure 2:
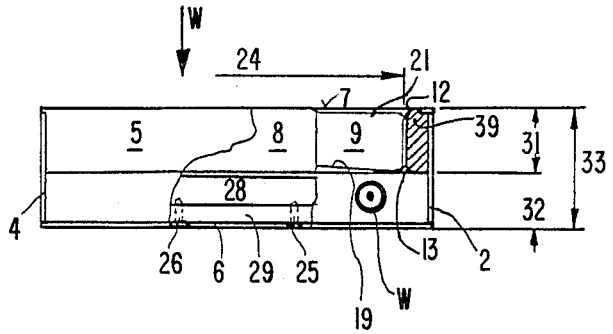

Referring now to the drawings wherein like reference numerals are used to designate like parts and more particularly to FIGS. 1 to 3 which show a first embodiment. In this case, FIG. 1 is a top view of the air inlet plane 7; FIG. 2 is a side view according to the Arrows II in FIGS. 1 and 3, showing the outlet opening 32, and FIG. 3 is a bottom view of the closed second main surface or bottom rear wall 6 of the housing. The right-hand portion of FIG. 2 shows a partial sectional view according to the cutting line II—II of FIG. 3. FIG. 1 and FIG. 2 show a central driving motor 8 which advantageously is developed as a so-called external rotor motor. In this case, it carries five axial flow blades 9 that are tilted by about 45° and are slightly bent. If the motor is an external rotor, the impeller advantageously is a one-piece plastic part having a cup-shaped hub that is put in an inverted position over the motor, and plastic blades 9 are integrally injection-molded onto it. The driving motor, that is located inside the impeller hub 8, via screw elements 25, 26, is fastened by means of its stator from the direction of the closed base plate 6. The internal stator, that is disposed under the impeller hub 8, is fastened via the flange part 28; and via the plate 29, the whole impeller with the rotor is fastened so that it is also rotatably disposed. The outflow direction of the fan is marked by the arrows W. The air inlet plane 7 ends with the housing top of the. The head of the impeller hub and the blade edges 21 on the inlet side are also located in this plane. Radial outwards of the blade 9 is a cylindrical member 39 which has a round inlet part 12 located at the inlet side of the fan facing the blades. Similar structure is shown in the embodiment of FIG. 4.

As shown in FIG. 1, the air guiding duct around the blades 9 is a cylinder 39 with the inside diameter 27. In the case of one successful embodiment, it measures 115 mm. The pertaining impeller 9 diameter 24 measures about 112 to 113 mm. This means that there is an air gap of 1 mm radially on the outside, between the blades and the surrounding wall. That is still acceptable with respect to the flow quality and manufacturing expenditures. The smaller the gap, the better is the flow, but more expensive is the manufacturing.

The walls 2, 3, 4 are closed lateral surfaces, while the lateral surface 5 is open. The air in the area of the axial height 32 flows laterally out through the lateral surface 5. In this lower area 32, only the stator with the flange 28 is disposed, and the fastening element 29 is provided centrally in the area of the motor. In the successful embodiment, the measurement of the partial axial height 32 is 17 mm, while the upper partial axial measurement 31 is 22 mm. The exhaust opening 32 in the plane of the lateral surface 5 therefore starts in the area below the blade 9 whereat side edge 19, as shown below the top portion of the lateral surface 5 in FIG. 2. FIG. 2 is therefore a partial sectional view. The upper portion of surface 5, that in the partial sectional view of FIG. 2 shows the wall ring 39 with the rounded edges 12, 13 on the inlet side and outlet side, each having a radius of curvature of about 5 mm in the embodiment, circumferentially surrounds the blades. On the outlet side of the housing, namely the lateral surface 5, barely half of this lateral surface is open at 32, for use as the outlet. The closed interior wall surfaces 2, 3, 4 are recessed outwardly from the flow wall ring 39 (having an inside diameter 27) by a certain amount so that the flow after leaving the impeller 9 in an axial direction (downwardly in FIG. 2) can at first still open up into a slightly larger cross-section defined by the side wall dimensions 22. However, it is advantageous for the corner areas in the housing below the wall ring 39 and between the rectangular inner surfaces of the walls 2, 3 and 4, to extend from the center of the wall 3 to the center of the wall 2 and to the center of the wall 4 in a rounded out circular manner such that the distance between this interior circular wall surface connecting the centers of the plane walls 2, 3 and 4 is approximately equal to the inside diameter 27 of the wall ring 39; i.e., the wall, from one center to the other, in a way that is not shown in FIGS. 1 to 3, is rounded out in a circular shape, in which case the center of the circle is the axis of rotation of the fan.

The full axial impeller dimension of 22 mm (seen in axial flow direction) is therefore located behind the closed area of the lateral surface 5 with the height 31.

For the purpose of minimizing noise according to the invention, normal axial impellers that are axially compact can be inserted into a housing that corresponds to the invention. A favorable ratio will then be obtained between a low but still quite useful pressure and volume and the noise values. It is important that the preferably cylindrical flow tube (39) axially surrounds the impeller completely.

It should be pointed out that fans of this type are standardized in all outer dimensions and therefore have maximum dimensions. Within these dimensions, different fans having an optimum of noise reduction and required capacity or pressure must be achieved. Thus various fan sizes and configurations are used to fit into this standardized outer dimension. Because of the fact that the fan can be fastened, in the simple way shown in FIG. 2, is possible to mount various fans directly to the rear wall 6 because the axial impeller with a stator can be practically extended via the elements 28, 29, 25, 26 The use of fan housings of this type, for conventional radial impellers is still possible.

FIGS. 1 to 3 show the first embodiment in half its natural size.

In FIGS. 4 to 9, the same reference numbers as in FIGS. 1 to 3 are used for the parts that have the same function while corresponding parts are prefaced by the numeral 100.

In the case of the second embodiment according to FIG. 4 to 9, the impeller diameter 124 is slightly more reduced with respect to the outer overall dimension 112 of the housing amounting to approximately 67% of the dimension 122. The rotational speed (about 2,300 rpm) of this smaller axial impeller is higher than the rotational speed (about 2,000 rpm) of the impeller according to FIGS. 1 to 3 of the first embodiment, the diameter of which is larger (amounting to approximately 83% of the measurements of the housing 22). The second embodiment meets the demands with respect to noise reduction very well, irrespective of the fact that the pressure requirement is twice as high compared to the first embodiment. The eccentric positioning of the impeller 9 in the housing that is used in the second embodiment is known per se and still results in a certain improvement of the air output while the noise remains low.

In FIG. 10, the characteristic resistance curves AW1 and AW2 are entered by interrupted lines for two certain applications. AX1 is the characteristic fan curve for the first embodiment. The operating point AP1 may also, as previously, be operated by means of a radial fan wheel according to the characteristic curve RL. However, in that case, the noise would be much too high. If, also within the scope of the present invention, the axial wheel according to the first embodiment is operated in a fan of this type with an increased rotational speed, then the characteristic apparatus line AX1′ would apply, with the operating point AP2 of the characteristic resistance line AW2 being attained in this way. However, it was found that for this application, an arrangement according to the invention that is constructed according to embodiment 2 is better. The characteristic curve AX2 corresponds to this second embodiment, and with a further reduced impeller diameter and with a slightly higher rotational speed, despite the inreased pressure requirement, a very good noise behavior is still achieved (compare above values). In the case of this comparison, the outer dimensions of the rectangular parallelepiped housing are practically the same.

Similar to FIG. 2, FIG. 4 is a partial sectional view through a complete fan according to the second embodiment. In this case, similar to what was described in the German Patent Text 22 57 509, the fan housing is developed as a one-piece cup-shaped plastic part having the walls 2, 4, front plate 70 and flow ring 39, and is screwed against the bottom plate 6 that is developed as a simple punched bent component. On said bottom plate 6, the whole impeller is mounted with the coaxial, concentric, driving electric motor that is an external rotor motor, as in FIG. 2, by means of screws 25, 26 is attached against a conically indented circular fastening plate 129 that is pressed out of the bottom plate 6 and has a space 62 with respect to the bottom plane 6 (see FIG. 5). The distance 62 is maintained in such a way that it corresponds to the optimal axial position of the existing fan wheel 8, 9. The internal stator of the exteral rotor motor has a flange plate 28 that is developed in one piece with the inner bearing support pipe element 128 of the driving motor, so that the screws 25, 26 simply reach through the openings 25′, 26′ of the fastening plate 129 into theads of the flange ring 28, in which case the heads of the screws 25, 26 are located in the conical indentation.

The left side of FIG. 4, in a drawn-out way, shows the optimal axial position of the impeller, in which case the blade edges 21 on the inlet side are provided close to the inflow plane 7, but still in the area of the inlet rounding 12 edge of flow ring 39 and with, the blade edges 19 on the outlet side axially ending with the bottom edge 40 of the flow pipe 39.

The right side of FIG. 4 shows a somewhat less advantageous position which however is somewhat better for inflow conditions, because the edges 21 on the inlet side of the blades axially connect to the low point of inflow rounding edge 12 of the flow pipe 39. However, according to the embodiments of the invention, the impeller with its blades 9 should project approximately no further axially beyond the bottom edge 40 of the flow pipe 39 than is shown in the right part of FIG. 4, namely with the blades edges 19, 29 on the outlet side, no more than 2 mm or about 10% of the axial blade length below bottom edge 40. If the blade edge 29 on the outlet side is spaced axially further away from the end 40 of the flow pipe 39, the noise will be increased considerably.

FIG. 6 is a complete top view of the base plate 6, in which case, as mentioned above, screws 25, 26 for the mounting of the flange 28 of the motor reach through the openings 25', 26' of the circular, conically indented fastening plate 129 to which the base plate connects via a conical intermediate portion 67.

While FIGS. 4 to 6 represent the actual size of the second embodiment, FIGS. 7 to 9, for reasons of representation, are reduced. The axis of rotation 100, in the base plate of FIG. 6 as well as in FIG. 7, indicates the position of the impeller 8, 9 in the housing 6, 77. The eccentric offsetting is known per se, for example, from DE-PS 21 39 036, in which case the distance between the housing walls increases in flow direction. Thus in FIG. 7, the lengths 112, 113, 114 of the distances are characterized by the lengths of their arrows, which increase between the flow ring 39 and the round wall 139. The distances according to numbers 112, 113, 114 are approximately on the order of 1 to 3 to 3, in which case, on the outlet side, the outer round wall 139 was left out over the whole width 120 of the outlet cross-section.

In the case of the first embodiment, the outlet area on the lateral surface 5 is limited to the distance 32 between the flow ring 39 and the base plate 6, but in the case of the second embodiment, the outlet area extends over the full axial height 121 of the housing for the free outlet cross-section. However, the outlet flow under the edge 40 is certainly stronger in the area of the base plate 6. Whether the outlet height 121 is utilized only over a part (for example, part 32 of the housing height 33) or completely (at 133), is of only subordinate significance.

FIG. 7 shows a top view of the cup-shaped plastic housing from the bottom which housing is screwed against the base plate 6 according to FIGS. 5/6 which is not shown in FIG. 1. At the lower edge 45 of the opposing lateral walls 4, 2, as shown in FIG. 4, a surrounding shoulder 44 is provided above the circumference, into which the metallic base plate 6 engages in a form-locking manner, before it is screwed together with the plastic holding shell 77 via the bolt-type elements 71 to 74 that are injection-molded to it. In FIG. 7, the head surface 45 of the shoulder 44 that is practically in alignment with the exterior wall of the base plate 6 is drawn in black.

FIG. 7 shows the eccentric position of the impeller axis 100 in the housing. The axis 101 that is located symmetrically in the housing 77 has practically the same distance from the outer walls 2, 4 that corresponds to the radius 111 of the round wall 139 of the exhaust duct. The latter extends as a semicircle between the lateral walls 2, 4. In FIG. 7, the axis 100 is shown offset in two directions (a and b) counterclockwise from the direction of the axis of symmetry 101 (like the rotating direction of the impeller that is indicated by an interrupted line by means of the Arrow 107).

The first step (a) in outlet direction and the second step (b) subsequently to the left of the outlet direction each has a length of about 10% of the length of the radius 111. The round wall 139 extends axially from the top front plate 70 completely to the bottom plate 6, whereas the flow pipe 39 with its edge 40 terminates at a distance to the bottom plate 6.

While we have shown and described only plural embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A fan assembly having a rectangular parallelepiped housing and an impeller means having blade means and said impeller means being centrally driven by an electric motor; wherein an axis of rotation of the impeller means is perpendicular to a first main inlet surface of the housing and parallel to a flow through the fan; the flow through the fan being deflected by 90° and leaving the housing through at least one lateral surface of the housing that is perpendicular to said first main inlet surface; a second main closed wall surface in said housing that is opposite the first main inlet surface; outlet blade edges on the blade means are spaced downstream in a flow direction from the air inlet surface and spaced from the second main closed wall surface; the impeller means producing an axial flow through the blade means and having an air-guiding duct, that is formed by a wall means that radially and completely surrounds the blades means to cause flow through the fan to exit the outlet blade edges only in an axial direction.

2. A fan assembly according to claim 1, wherein an outside diameter of the impeller means is approximately 20% smaller than a dimension of the rectangular parallelepiped housing, perpendicular to the impeller rotation axis.

3. A fan assembly according to claim 2, wherein the impeller means has inlet blade edges means that are disposed in the area of the first main inlet surface plane.

4. A fan assembly according to claim 2, wherein the impeller outlet blade edge means are disposed approximately in the center of an axial height of the rectangular parallelepiped housing.

5. A fan assembly according to claim 2, wherein in the area of the air inlet blade edge means, the air guiding duct means radially and directly outside the blade means has a rounded inlet.

6. A fan assembly according to claim 1, wherein an outside diameter of the impeller means is approximately 30% smaller than a dimension of the rectangular parallelepiped housing, perpendicular to the impeller rotation axis.

7. A fan assembly according to claim 1, wherein the impeller means has inlet blade edges means that are disposed in the area of the first main inlet surface plane.

8. A fan assembly according to claim 7, wherein the impeller outlet blade edge means are disposed approximately in the center of an axial height of the rectangular parallelepiped housing.

9. A fan assembly according to claim 7, wherein in the area of the air inlet blade edge means, the air guiding duct means radially and directly outside the blade means has a rounded inlet.

10. A fan assembly according to claim 1, wherein the impeller outlet blade edge means are disposed approximately in the center of an axial height of the rectangular parallelepiped housing.

11. A fan assembly according to claim 10, wherein in the area of the air inlet blade edge means, the air guiding duct means radially and directly outside the blade means has a rounded inlet.

12. A fan assembly according to claim 11, wherein in the area of the outlet blade edge means, the air guiding duct means radially and directly outside the blade means, has a rounded outlet part so that the flow leaving the axial impeller, at first encounters an enlarged flow cross-section.

13. A fan assembly according to claim 12, wherein the flow after leaving the rounded outlet part passes to an enlarged flow cross-section, defined by a diameter member that is formed over a whole circumference of the housing means and is at least about 10% larger than an outside diameter of the impeller means.

14. A fan assembly according to claim 1, wherein the impeller means extends in the flow direction for at least over half the axial height of the housing.

15. A fan assembly according to claim 14, wherein the impeller means extends from at least one half to one third of the axial height of the housing, and wherein a flow outlet opening in the housing is located between the outlet edge means of the blade means and the closed wall surface and has a height of one half to one third of the axial height of the housing.

16. A fan assembly according to claim 1, wherein the distance between the main inlet surface and the closed wall surface is equal to about $\frac{1}{3}$ of the diameter of the impeller means.

17. A fan assembly according to claim 1, wherein the surrounding wall of the air guiding duct means is configured as an essentially cylindrical flow ring.

18. A fan assembly according to claim 1, wherein in the area of the air inlet blade edge means, the air guiding duct means radially and directly outside the blade means has a rounded inlet.

* * * * *